US006557743B2

(12) United States Patent
Schuster

(10) Patent No.: US 6,557,743 B2
(45) Date of Patent: May 6, 2003

(54) MULTI CHAMBER NAIL GUN

(75) Inventor: Michael G. Schuster, Joliet, IL (US)

(73) Assignee: George A. Schuster, Joliet, IL (US)

( * ) Notice: Subject to any disclaimer, the term of this patent is extended or adjusted under 35 U.S.C. 154(b) by 0 days.

(21) Appl. No.: 09/905,365

(22) Filed: Jul. 16, 2001

(65) Prior Publication Data

US 2003/0015566 A1 Jan. 23, 2003

(51) Int. Cl.[7] ..... B25C 5/02; B25C 5/06; B25C 5/16; B27F 7/00

(52) U.S. Cl. ..... 227/109; 227/137; 227/136; 227/120

(58) Field of Search ..... 227/109, 139, 227/120, 135, 136, 137, 107, 140

(56) References Cited

U.S. PATENT DOCUMENTS 4,139,136 A * 2/1979 Catalano ..... 227/109
5,575,415 A * 11/1996 Sucher ..... 227/109
6,161,746 A * 12/2000 Wey ..... 227/109
6,299,046 B1 * 10/2001 Chen ..... 227/109

* cited by examiner

*Primary Examiner*—Anthony D. Stashick
(74) *Attorney, Agent, or Firm*—Leydig, Voit & Mayer, Ltd.

(57) ABSTRACT

A powered nail gun is disclosed that has two chambers to hold nails of different sizes or types wherein each chamber can be selectively rotated into a ready-for-use position. A pivot assembly can be provided having a pivot member, a rotatable connecting plate depending therefrom, and first and second supply cartridges connected to the connecting plate and facing in opposing directions. Each supply cartridge has one of the chambers and a firing position to receive and position a nail for impact by a drive mechanism. When one of the supply cartridges is rotated to the ready-for-use position, its firing position is in registration with an impact end of the drive mechanism. Each supply cartridge includes a spring-biased follower to urge the nails in the cartridge toward the firing position.

11 Claims, 4 Drawing Sheets

MULTI CHAMBER NAIL GUN

FIELD OF THE INVENTION

This invention relates to the field of powered nail guns having an electrical or pneumatic driving mechanism and an impact member to strike the nail that has been moved into the operating position of a supply cartridge and drive it into a work piece. The invention relates in particular to a powered nail gun having a plurality of supply cartridges in which nails of different sizes can be carried, and in which different ones of the supply cartridges can be moved into position for use when nails of the size and type carried in that cartridge are needed.

BACKGROUND OF THE INVENTION

A few nail guns are known to the prior art in which nails of different sizes and types can be selected for use by the same nail gun. Prior art nail guns of this type known to the inventor include those disclosed in the following United States Patents which are readily available for inspection in a number of public libraries as well as in the United States Patent and Trademark Office by members of the public and others having a need or interest in examining such patents:

| | | |
|---|---|---|
| 6,173,877 | 5,096,109 | 3,007,171 |
| 6,161,746 | 4,139,136 | 2,147,208 |
| 5,556,020 | 3,504,840 | 1,709,399 |
| 5,575,415 | 3,266,697 | |

SUMMARY OF THE INVENTION

The present invention includes an improvement over powered nail guns known to the prior art. It provides a powered nail gun in which two separate supply magazines or cartridges are carried on a pivot member whereby each can be selectively rotated into position for use. Each supply magazine or cartridge can be loaded with nails of different sizes or types. Thus, when a workman needs a nail of the type or size carried in the supply cartridge not then in position for use, he merely needs to rotate the one cartridge out of position and the cartridge with the desired nails into the ready-for-use position.

DESCRIPTION OF PREFERRED EMBODIMENT

Figure 1:
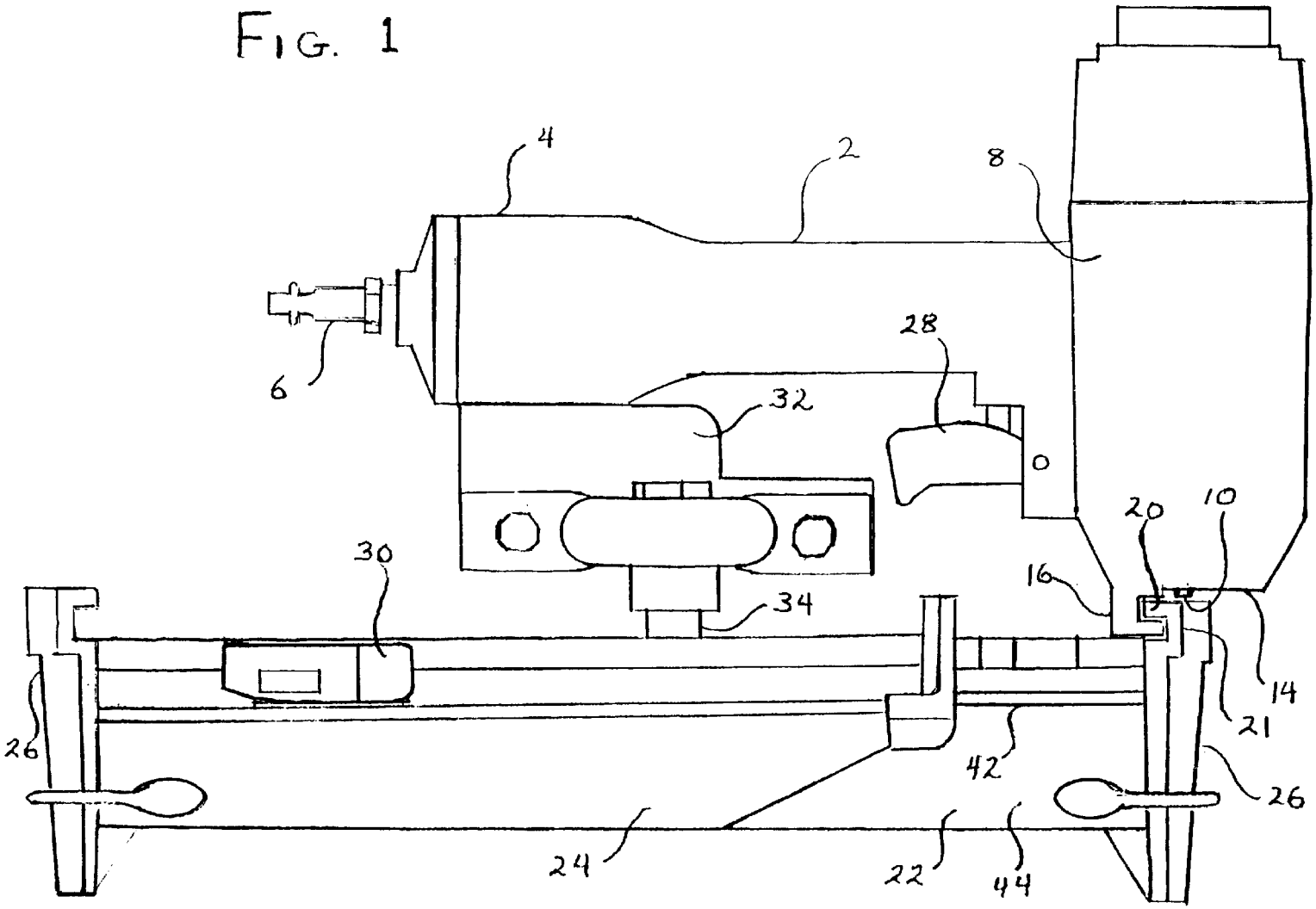
FIG. 1 is an elevation view of a multi chamber nail gun in accordance with this invention, having two supply chambers or cartridges mounted on a pivot assembly, the supply cartridge which is in the ready-for-use position being partially blocked from view by the second supply cartridge which is rotated out of its ready-for-use position.
Figure 2:
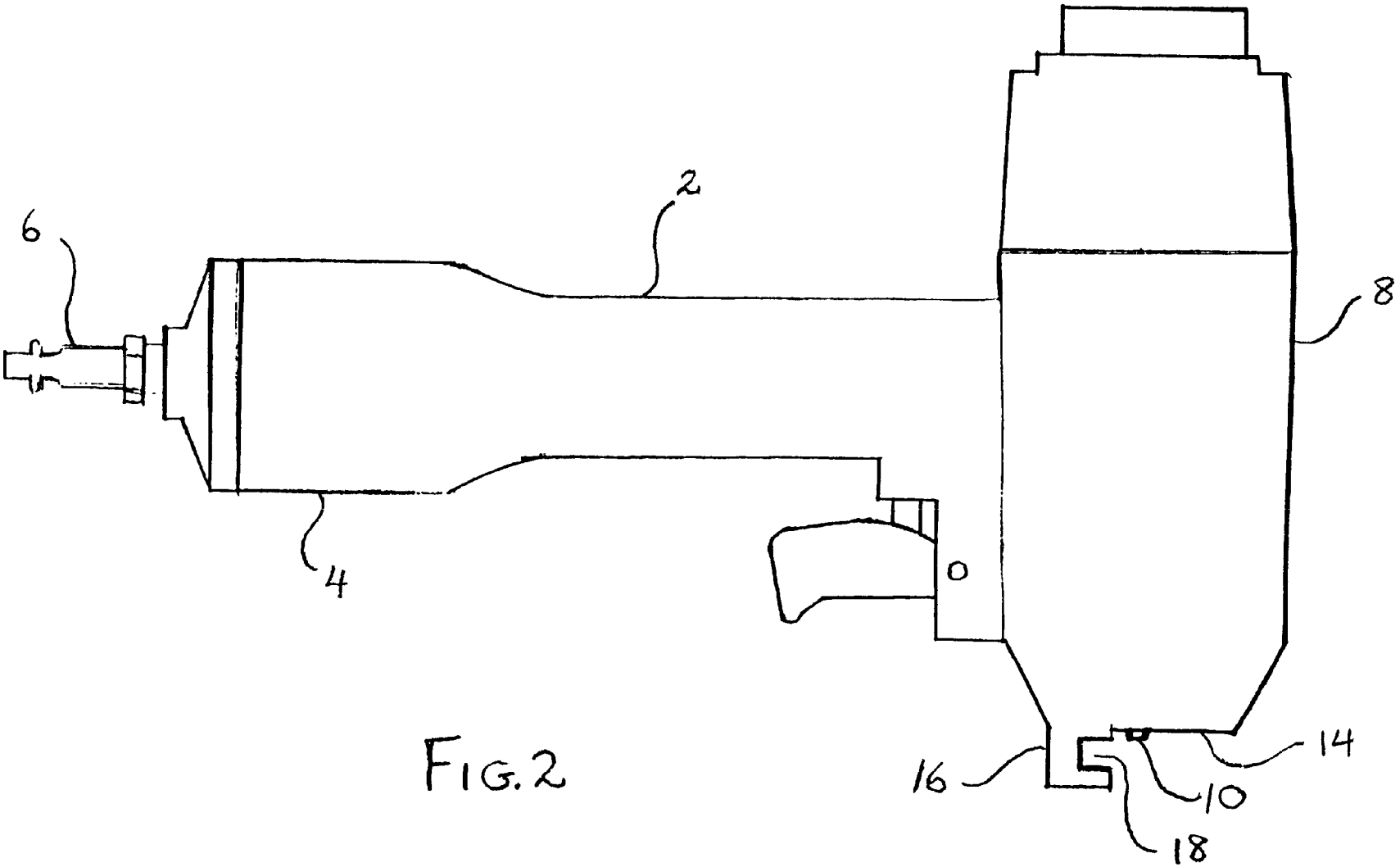
FIG. 2 is an elevation view of a pneumatic nail gun as seen in FIG. 1 but without the pivot assembly and supply cartridges to more clearly show some of the structural details.
Figure 3:
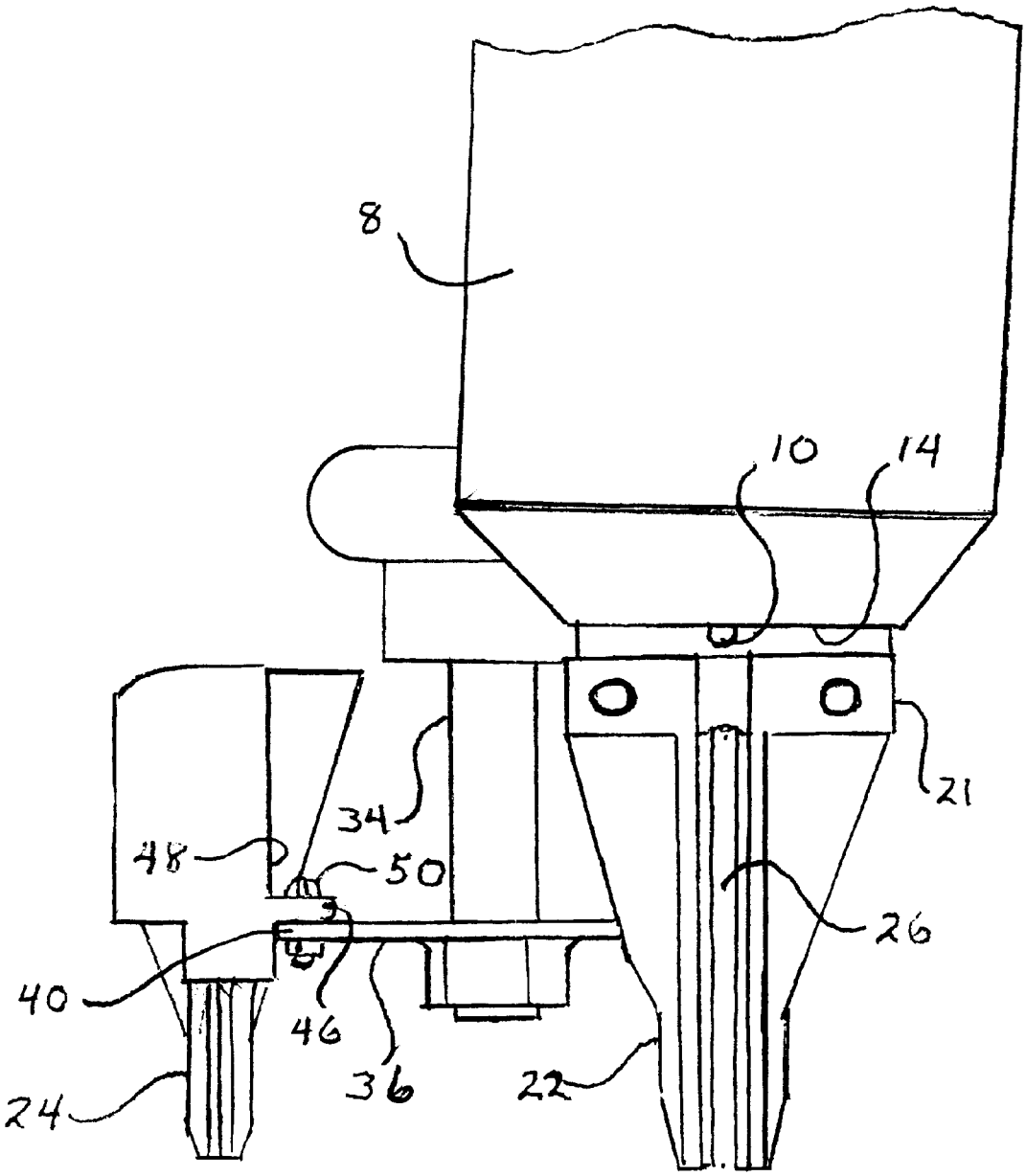
FIG. 3 is a front end view of the multi chamber nail gun in accordance with this invention, with a portion of the cylinder housing broken away, illustrating the two supply cartridges in side-by-side relationship mounted on the connecting plate secured at the lower end of the pivot bolt, one of the supply cartridges shown in the ready-for use position and with the front end cap removed which normally covers the firing position showing the impact end of the drive rod in registration therewith to impact a nail received in the firing position when the cartridge has been loaded with a supply of nails.
Figure 4:
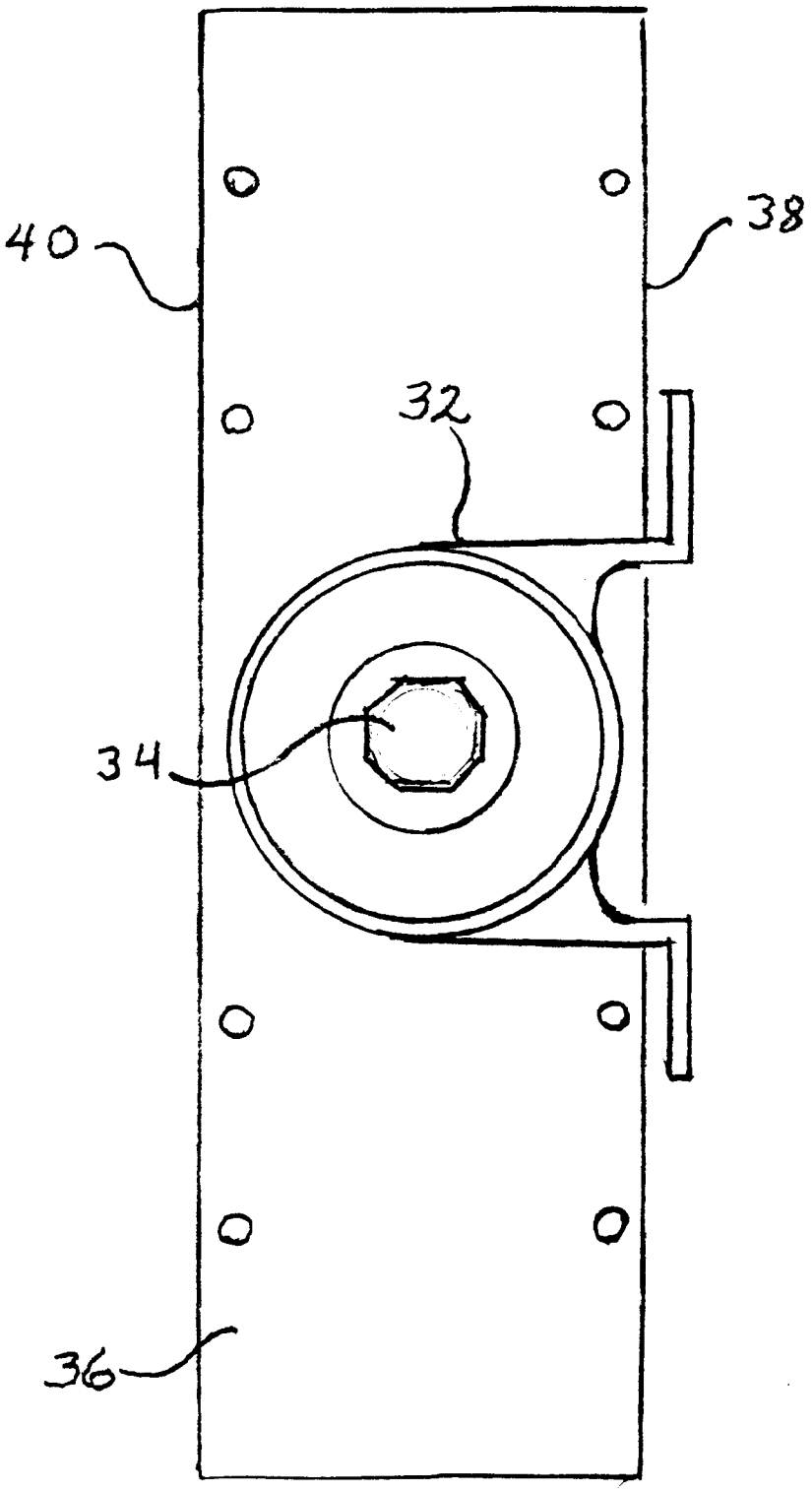
FIG. 4 is a plan view of the pivot assembly disconnected from the nail gun to better illustrate the detail structure, with the connecting plate connected to the pivot assembly to which the respective supply cartridges are connected along each opposite side when fully assembled.

A dual chamber nail gun in accordance with this invention includes a pneumatically powered nail gun 2, having a pressurized air chamber in a compressed air housing 4 with a fitting 6 for connection to an air hose leading to a source of pressurized air, a cylinder housing 8 with an operating cylinder, piston and piston drive rod therein having an impact end 10 of the drive rod extending through an aperture at the lower end wall 14 of the cylinder housing 8.

A positioning guide structure 16 extends downwardly from the lower end 14 of the cylinder housing 8 having a laterally extending groove 18 to receive a corresponding stabilizing rib 20 at the upper edge of the forward end wall 21 of the supply cartridges or magazines 22 and 24 when moved into position. When moved into such position, a nail in the forward firing position 26 of the supply cartridge, is then centered below and in registration with the impact end 10 of the drive rod. When the trigger 28 is pulled, a charge of pressurized air is admitted into the operating cylinder driving the piston, drive rod and impact end 10 against the nail to drive it into the work piece. A spring biased follower 30 urges succeeding nails in the cartridges forward into the firing position 26.

In accordance with the present invention, two supply cartridges or magazines 22 and 24 are provided in which nails of different sizes can be loaded and selectively moved into position for driving nails of different sizes as needed. The supply cartridges 22 and 24 are pivotally mounted on a mounting bracket 32 which extends down from the compressed air housing 4 to swivel in a horizontal plane that is parallel to the horizontal plane of the lower end wall 14 of the cylinder housing 8. A pivot bolt 34 extends vertically through the mounting bracket 32 at one side thereof and is bolted to an elongated connecting plate 36 at its lower end. The connecting plate 36 has a first elongated side edge 38 and an opposite second elongated side edge 40 spaced apart therefrom and parallel thereto.

The supply cartridge 22 is bolted or otherwise secured to elongated side edge 38 and supply cartridge 24 is bolted or otherwise secured to elongated side edge 40. Supply cartridge 22 includes an elongated rib 42 extending outwardly from its side wall 44, and supply cartridge 24 includes an elongated rib 46 extending outwardly from its side wall 48. Bolts or screws 50 extend through the ribs 42 and 46 and the respective side edges 38 and 40 of the connecting plate 36. Supply cartridge 22 is secured to side edge 38 with its firing position 26 facing in one direction, and supply cartridge 24 is secured to the opposite side edge 40 with its firing position 26 facing in the opposite direction.

The mounting bracket 32, pivot bolt 34 and connecting plate 36 are positioned to locate the supply cartridges 22 and 24 in position relative to the cylinder housing 8 whereby the drive mechanism therein including impact end 10 of the impact drive rod is in registration with a nail in the firing position 26 of a respective one of the supply cartridges, when one of those supply cartridges has been pivoted or rotated to such ready for use position.

At such time, the supply cartridge in the ready for use position, for example supply cartridge 22, extends below the compressed air housing 4, spaced apart therefrom and in substantial alignment with the longitudinal axis of the compressed air housing. The stabilizing rib 20 at the forward end of the supply cartridge 22 in its ready for use position is at such time received in the groove 18 of the positioning guide structure 16, with the drive rod impact end 10 centered on the firing position 26 at the forward end of the supply cartridge 22, in registration with a nail pushed forwardly into such firing position by the spring biased follower 30.

At such time, the other supply cartridge 24 is in its out of use position, spaced apart from supply cartridge 22 in its ready for use position and having its forward firing position 26 facing in the opposite direction from that of the supply cartridge 22.

Supply cartridge 22 may be loaded with nails of one size. Supply cartridge 24 may be loaded with nails of a different size. When a nail of the size being carried in the supply cartridge 24 is to be driven into a work piece, the connecting plate 36 is pivoted to rotate supply cartridge 22 out of its ready for use position whereupon supply cartridge 24 rotates into the ready for use position, with its stabilizing rib 20 sliding into the groove 18 of the positioning guide structure 16 until the firing position 26 of the supply cartridge 24 is centered under the drive rod impact end 10 and in registration with a nail pushed therein by the spring biased follower 30 of the supply cartridge 24.

I claim:

1. A nail gun comprising:

a first supply cartridge to carry a first supply of nails;

a second supply cartridge to carry a second supply of nails;

a drive mechanism including an impact end to impact and drive a nail into a work piece, said first supply cartridge having a drive position to receive and position a nail for impact by said impact end of said drive mechanism, said second supply cartridge having a drive position to receive and position a nail for impact by said impact end of said drive mechanism; and selective positioning means for selectively positioning said drive position of said first supply cartridge in registration with said impact end of said nail gun drive mechanism when in one position and then positioning said drive position of said second supply cartridge in registration with said impact end of said nail gun drive mechanism when in a second position, said selective positioning means comprising pivot means to selectively rotate said first supply cartridge into a ready-for-use position wherein its said drive position is in registration with said impact end of said drive mechanism and said second supply cartridge at such time out of a ready-to-use position, and to thereafter when desired rotate said second supply cartridge into a ready-for-use position wherein its said drive position is in registration with said impact end of said drive mechanism and said first supply cartridge at such time out of a ready-for-use position;

wherein said nail gun is pneumatically powered, having a compressed air housing in communication with said drive mechanism and said impact end thereof.

2. The nail gun as set forth in claim 1, wherein said pivot means of said selective positioning means includes a rotatable pivot member, an elongated connecting plate connected to said rotatable pivot member for rotation thereof, said elongated connecting plate having a first elongated side edge, a second opposite elongated side edge, said first supply cartridge being elongated having a first elongated side wall, a first elongated rib extending outwardly from said first side wall, securing means to secure said first elongated rib of said first side wall of said first supply cartridge to said first elongated side edge of said elongated connecting plate, said second supply cartridge being elongated having a second elongated side wall, a second elongated rib extending outwardly from said second side wall, securing means to secure said second elongated rib of said second side wall of said second supply cartridge to said second elongated side edge of said elongated connecting plate.

3. The nail gun as set forth in claim 2, wherein said nail gun includes a mounting bracket having an upper end and a lower end, said upper end of said mounting bracket being secured to said compressed air housing, said pivot member being elongated and connected to said lower end of said mounting bracket to one side thereof, said nail gun includes a cylindrical housing for said drive mechanism, said cylindrical housing having an upper end and a lower end wall having a planar surface lying in a first plane, the longitudinal axis of said cylindrical housing extending in one longitudinal direction, the longitudinal axis of said elongated pivot member extending in the same longitudinal direction as that of said cylindrical housing, said elongated connecting plate having a planar surface normal to the longitudinal axis of said pivot member to rotate in a second plane that is parallel to and spaced apart below said first plane.

4. The nail gun as set forth in claim 3, wherein said cylindrical chamber includes a stabilizing structure extending downwardly from said lower end wall thereof, a laterally extending receiving groove therein, each of said first and second supply cartridges having a forward end wall with an upper edge, a stabilizing rib extending laterally along said upper edge in registration with said receiving groove when respective ones of said supply cartridges are rotated on said pivot member into their ready-for-use positions.

5. The nail gun as set forth in claim 4, wherein said first elongated supply cartridge includes a first longitudinal axis, said compressed air housing includes an air housing longitudinal axis parallel to and spaced apart from said first longitudinal axis when said first supply cartridge is in its said ready-for-use position.

6. The nail gun as set forth in claim 4, wherein said second elongated supply cartridge includes a second longitudinal axis, said compressed air housing includes an air housing longitudinal axis parallel to and spaced apart from said second longitudinal axis when said second supply cartridge is in its said ready-for-use position.

7. The nail gun as set forth in claim 1, wherein said first supply cartridge is elongated, having a first end and an opposite second end, said drive position of said first supply cartridge is at said first end thereof.

8. The nail gun as set forth in claim 1, wherein said second supply cartridge is elongated, having a first end and an opposite second end, said drive position of said second supply cartridge is at said first end thereof.

9. A multi-chamber nail gun comprising:

a first chamber to carry a first supply of nails;

a second chamber to carry a second supply of nails;

a drive mechanism including a selectively movable impact end, said first chamber having a drive position to receive and position a nail for impact by said impact end of said drive mechanism, said second chamber having a drive position to receive and position a nail for impact by said impact end of said drive mechanism; and selective positioning means for selectively positioning said drive position of said first chamber in registration with said impact end of said drive mechanism when in one position and then positioning said drive position of said second chamber in registration with said impact end of said drive mechanism when in a second position, said selective positioning means comprising pivot means to selectively rotate said first chamber into a ready-for-use position wherein its said drive position is in registration with said impact end of said drive mechanism and said second chamber at such time out of a ready-to-use position, and to thereafter when desired rotate said second chamber into a ready-for-use position wherein its said drive position is in registration with said impact end of said drive mechanism and said first chamber at such time out of a ready-for-use position.

10. The multi-chamber nail gun as set forth in claim 9, wherein said first chamber is disposed in a first supply cartridge, said first supply cartridge being elongated and having a first end and an opposite second end, said drive position of said first chamber being at said first end of said first supply cartridge.

11. The multi-chamber nail gun as set forth in claim 10, wherein said second chamber is disposed in a second supply cartridge, said second supply cartridge being elongated and having a first end and an opposite second end, said drive position of said second chamber being at said first end of said second supply cartridge.

* * * * *